US011878883B2

(12) United States Patent
Nakashima

(10) Patent No.: US 11,878,883 B2
(45) Date of Patent: Jan. 23, 2024

(54) MEDIUM FEEDING APPARATUS AND IMAGE READING APPARATUS

(71) Applicant: SEIKO EPSON CORPORATION, Tokyo (JP)

(72) Inventor: Hiroki Nakashima, Fukuoka (JP)

(73) Assignee: SEIKO EPSON CORPORATION, Tokyo (JP)

( * ) Notice: Subject to any disclaimer, the term of this patent is extended or adjusted under 35 U.S.C. 154(b) by 143 days.

(21) Appl. No.: 17/131,233

(22) Filed: Dec. 22, 2020

(65) Prior Publication Data

US 2021/0198058 A1 Jul. 1, 2021

(30) Foreign Application Priority Data

Dec. 26, 2019 (JP) ..... 2019-235899

(51) Int. Cl.
*B65H 1/08* (2006.01)
*B65H 1/02* (2006.01)
*B65H 5/06* (2006.01)

(52) U.S. Cl.
CPC ..... *B65H 1/025* (2013.01); *B65H 5/068* (2013.01); *B65H 2301/42262* (2013.01); *B65H 2511/214* (2013.01); *B65H 2801/03* (2013.01)

(58) Field of Classification Search
CPC ..... B65H 1/025; B65H 5/068; B65H 2301/42262; B65H 2511/214; B65H 2801/03; B65H 1/10; B65H 1/12; B65H 1/266; B65H 1/08
See application file for complete search history.

(56) References Cited

U.S. PATENT DOCUMENTS 4,548,395 A * 10/1985 Snellman ..... B65H 3/063 271/99
5,145,163 A * 9/1992 Cowan ..... B65H 3/0684 271/167
7,111,934 B2 * 9/2006 Okuda ..... B41J 3/4071 271/167
8,602,410 B2 * 12/2013 Kuriki ..... B65H 1/02 271/171

(Continued)

FOREIGN PATENT DOCUMENTS

EP 1821265 * 8/2007
JP 2000053260 A 2/2000

(Continued)

OTHER PUBLICATIONS

Office Action for JP Patent Application No. JP2019-235899, dated Sep. 5, 2023, 9 pages of Office Action.

*Primary Examiner* — Thomas A Morrison
(74) *Attorney, Agent, or Firm* — CHIP LAW GROUP

(57) ABSTRACT

An image reading apparatus includes a reading unit and a medium feeding apparatus. The medium feeding apparatus includes: a medium placement portion on which a medium before being fed is placed; a feed roller that feeds the medium placed on the medium placement portion; and at least one pressing portion that presses the medium placed on the medium placement portion onto the medium placement portion at a position upstream of the feed roller in a medium feeding direction. Since the pressing portion presses the medium placed on the medium placement portion, friction occurs between sheets of the medium, thereby preventing or reducing a skew.

12 Claims, 7 Drawing Sheets

(56) References Cited

U.S. PATENT DOCUMENTS

| | | | | |
|---|---|---|---|---|
| 8,708,327 | B2 * | 4/2014 | Suzuki | B65H 3/063 271/130 |
| 9,950,888 | B2 * | 4/2018 | Yonemura | B65H 3/5284 |
| 11,267,665 | B2 | 3/2022 | Anami | |
| 2018/0257895 | A1 * | 9/2018 | Kaneko | B65H 31/22 |
| 2019/0329996 | A1 | 10/2019 | Anami | |

FOREIGN PATENT DOCUMENTS

| | | | |
|---|---|---|---|
| JP | 2016013880 | A | 1/2016 |
| JP | 2017165575 | A | 9/2017 |
| JP | 2019189425 | A | 10/2019 |

* cited by examiner

MEDIUM FEEDING APPARATUS AND IMAGE READING APPARATUS

The present application is based on, and claims priority from JP Application Serial Number 2019-235899, filed Dec. 26, 2019, the disclosure of which is hereby incorporated by reference herein in its entirety.

BACKGROUND

1. Technical Field

Embodiments of the present disclosure relate to a medium feeding apparatus that feeds a medium, and an image reading apparatus provided with the medium feeding apparatus.

2. Related Art

Some scanners as an example of an image reading apparatus are provided with an automatic document feeder and are able to automatically feed and read plural sheets of a document as an example of a medium.

In such an automatic document feeder, edge guides, by which the edges of a document in the width direction are guided, are provided on a document placement portion, on which the document is placed, such that they are able to slide in accordance with the size of the document as disclosed in JP-A-2017-165575.

If sheets of the document placed on the document placement portion are the same in size in the width direction of the document, the edges of the document in the width direction are guided by the edge guides. Guiding the edges prevents or reduces a skew. However, if sheets of the document placed on the document placement portion are not the same in size in the width direction of the document, meaning that there are a sheet(s) having a relatively large size and a sheet(s) having a relatively small size in a mixed manner on the document placement portion, the edges of the smaller document in the width direction are not guided, making it impossible to prevent or reduce a skew.

SUMMARY

A medium feeding apparatus according to a certain aspect of the present disclosure includes: a medium placement portion on which a medium before being fed is placed; a feed roller that feeds the medium placed on the medium placement portion; and at least one pressing portion that presses the medium placed on the medium placement portion onto the medium placement portion at a position upstream of the feed roller in a medium feeding direction.

An image reading apparatus according to a certain aspect of the present disclosure includes: a reading unit that reads a surface of the medium; and the medium feeding apparatus.

DESCRIPTION OF EXEMPLARY EMBODIMENTS

Figure 1:
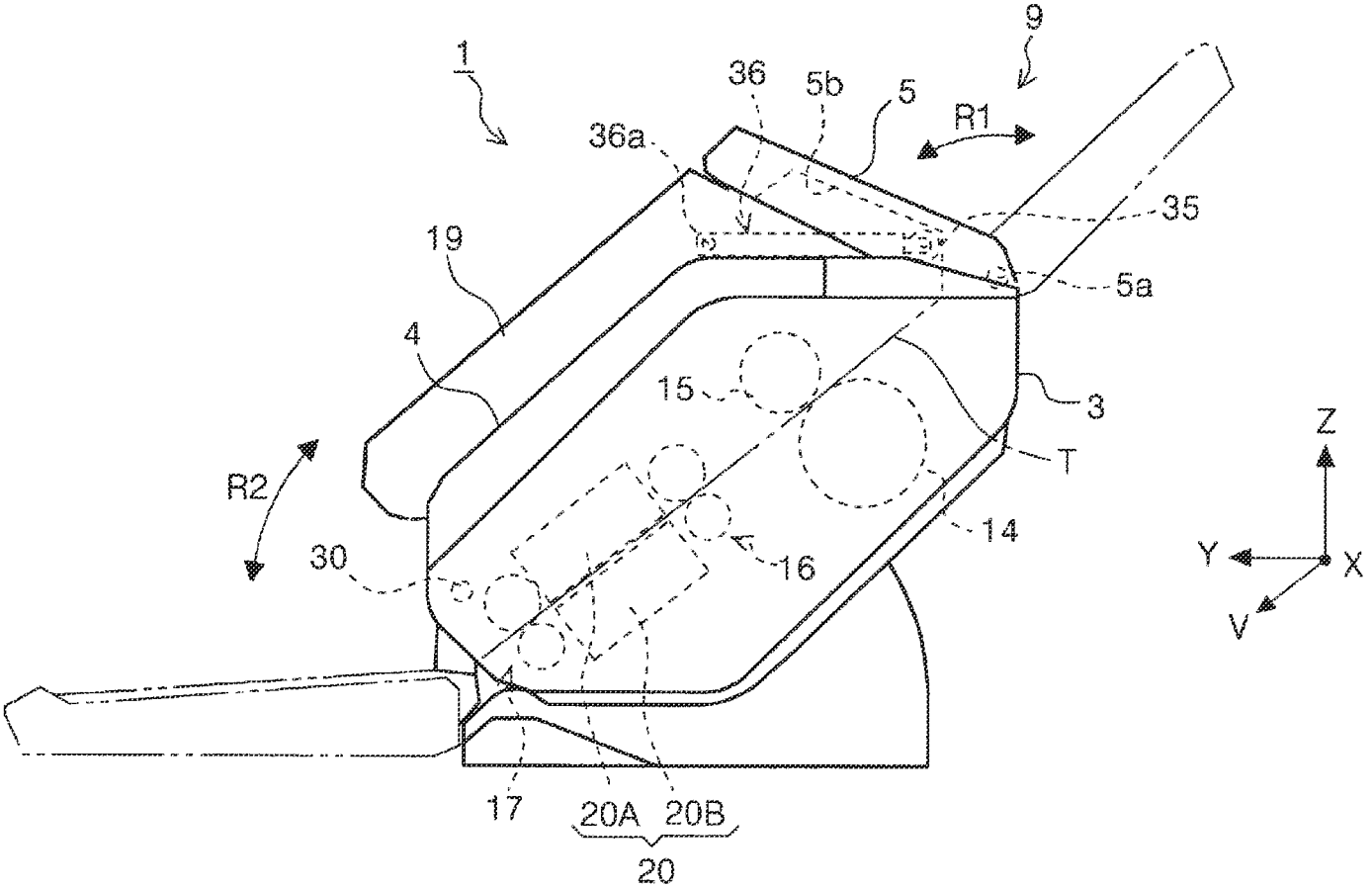
FIG. 1 is a side view of a document feeding path of a scanner according to a first embodiment.

First, a brief overview of the present disclosure is presented below.

A medium feeding apparatus according to a first aspect of the present disclosure includes: a medium placement portion on which a medium before being fed is placed; a feed roller that feeds the medium placed on the medium placement portion; and at least one pressing portion that presses the medium placed on the medium placement portion onto the medium placement portion at a position upstream of the feed roller in a medium feeding direction.

In this aspect, since the medium feeding apparatus includes at least one pressing portion that presses the medium placed on the medium placement portion onto the medium placement portion at a position upstream of the feed roller in a medium feeding direction, a force of friction acts between sheets of the medium placed on the medium placement portion. Because of the force of friction, it is possible to prevent or reduce a skew. Even if only a single sheet of the medium is placed on the medium placement portion, a force of friction acts between the medium and the pressing portion. Therefore, it is possible to prevent or reduce a skew.

A second aspect is that, in the first aspect, the pressing portion is configured such that a pressing position where the pressing portion presses the medium is adjustable in the medium feeding direction.

In this aspect, since the pressing portion is configured such that a pressing position where the pressing portion presses the medium is adjustable in the medium feeding direction, it is possible to press the medium at a suitable position depending on the length of the medium in the medium feeding direction.

The medium feeding apparatus of the third aspect further includes, in addition to those of the second aspect: a lower unit that includes the medium placement portion; an upper unit that is provided over the lower unit; a medium feeding path along which the medium is fed and which is formed between the lower unit and the upper unit; and a pivoting portion that is able to pivot with respect to the upper unit; wherein the pressing portion is provided on a free end that is away from the center of pivoting of the pivoting portion.

In this aspect, since the pressing portion is provided on a free end that is away from the center of pivoting of the pivoting portion configured to be able to pivot with respect to the upper unit, the position of the pressing portion is able to change suitably in accordance with the height of the stack of the sheets of the medium on the medium placement portion.

A fourth aspect is that, in the third aspect, the pivoting portion includes a base portion that is pivotable and at least one slide portion that is located in a direction toward the free end with respect to the base portion and is able to slide with respect to the base portion, and a length of the pivoting portion changes to adjust the pressing position due to sliding of the slide portion with respect to the base portion.

This aspect makes it possible to mechanically adjust the pressing position with a simple structure.

A fifth aspect is that, in the fourth aspect, the pivoting portion is urged by a pressing member in a pivoting direction of pushing the pressing portion against the medium placed on the medium placement portion.

In this aspect, since the pivoting portion is urged by a pressing member in a pivoting direction of pushing the pressing portion against the medium placed on the medium placement portion, it is possible to easily adjust a pressing force applied by the pressing portion to press the medium, by adjusting a press-urging force applied by the pressing member.

A sixth aspect is that, in the fourth aspect, the medium placement portion is able to rotate with respect to the lower unit and is able to, by rotating, switch between a first position, at which the medium placement portion supports the medium, and a second position, at which the medium placement portion covers a medium feed port formed between the lower unit and the upper unit.

In this aspect, since the medium placement portion is able to rotate with respect to the lower unit and is able to, by rotating, switch between a first position, at which the medium placement portion supports the medium, and a second position, at which the medium placement portion covers a medium feed port formed between the lower unit and the upper unit, it is possible to save the installation space of the apparatus by putting the medium placement portion into the second position when the apparatus is not in use.

A seventh aspect is that, in the sixth aspect, by switching of the medium placement portion from the first position to the second position, the medium placement portion pushes the slide portion toward the base portion, resulting in making the length of the pivoting portion shorter.

In this aspect, by switching of the medium placement portion from the first position to the second position, the medium placement portion pushes the slide portion toward the base portion, resulting in making the length of the pivoting portion shorter. That is, the pivoting portion changes into a slider-housed state in link with switching in position of the medium placement portion. This structure enhances the ease of user operation.

An eighth aspect is that, in the first aspect, the pressing portion is a roller that rotates in contact with the medium.

In this aspect, since the pressing portion is a roller that rotates in contact with the medium, it is possible to prevent the medium from being damaged by the pressing portion when the medium in contact with the pressing portion is fed.

A ninth aspect is that, in the first aspect, the pressing portion is provided at a position of overlapping with the feed roller in a width direction that intersects with the medium feeding direction.

In this aspect, since the pressing portion is provided at a position of overlapping with the feed roller in a width direction that intersects with the medium feeding direction, it is possible to prevent or reduce a skew that would be caused if the position where the pressing portion presses the medium and the position where a force for feeding the medium is applied by the feed roller to the medium were significantly not in alignment with each other as viewed in the width direction.

The medium feeding apparatus of the tenth aspect further includes, in addition to those of the first aspect: a pair of edge guides that are able to slide in the width direction that intersects with the medium feeding direction; wherein the pressing portion is provided either at a center position between the pair of edge guides in the width direction or at symmetrical positions with respect to the center position.

In this aspect, since the pressing portion is provided either at a center position between the pair of edge guides in the width direction or at symmetrical positions with respect to the center position, a balance is kept between the position where the pressing portion presses the medium and the positions where the pair of edge guides restrict the edges of the medium, thereby preventing or reducing a skew of the medium.

An eleventh aspect is that, in the third aspect, the pivoting portion serves also as a supporting unit that supports the ejected medium in a tilted position.

In this aspect, since the pivoting portion serves also as a supporting unit that supports the ejected medium in a tilted position, it is possible to reduce the cost of the apparatus.

The medium feeding apparatus of the twelfth aspect further includes, in addition to those of the first aspect: a skew correction unit that corrects a skew of the document; a pressing state switcher that switches between a pressing state, in which the medium is pressed by the pressing portion, and a pressing released state, in which the pressing is released; and a control unit that controls the skew correction unit and the pressing state switcher; wherein the control unit causes the skew correction unit to correct the skew of the document after putting the pressing portion into the pressing released state.

In this aspect, since the control unit causes the skew correction unit to correct the skew of the document after putting the pressing portion into the pressing released state, it is possible to correct the skew of the medium properly, without being obstructed by the pressing of the medium by the pressing portion.

An image reading apparatus according to a thirteenth aspect of the present disclosure includes: a reading unit that reads a surface of the medium; and the medium feeding apparatus according to the first aspect.

With this aspect, the same operational effects as those described above can be obtained in the image reading apparatus.

Next, embodiments of the present disclosure will now be explained with specific examples.

In the description below, a scanner 1 capable of reading at least one of the front and back of a sheet of a document, which is an example of a medium, is taken as an example of an image reading apparatus. The scanner 1 is a so-called document scanner that performs reading while moving a document across a reading unit.

In the X-Y-Z coordinate system depicted in each figure, the X-axis direction represents the width direction of the apparatus, meaning the width direction of a document. The Y-axis direction represents the depth direction of the apparatus, which is along the horizontal direction. The Z-axis direction is along the vertical direction. The V-axis direction is parallel to a document feeding direction.

In the description below, the direction in which a document is fed (the +V direction) is sometimes described as "downstream", and the opposite direction (the −V direction) is sometimes described as "upstream". The +V direction is the downstream document feeding direction.

In FIG. 1, the scanner 1 includes a lower unit 3 and an upper unit 4.

A user can open and close the upper unit 4 by rotating it on a non-illustrated pivot shaft away from and toward the lower unit 3. Opening the upper unit 4 exposes a document feeding path T. Closing the upper unit 4 forms the document feeding path T between the upper unit 4 and the lower unit 3 and forms a feed port 6 (see FIG. 2) for feeding a document.

The upper unit 4 includes a front cover 19. The lower unit 3 includes a document placement portion 5, which serves also as a top cover. The front cover 19 is configured to be able to rotate on a rotation shaft 30 in a direction indicated by an arrow R2 with respect to the lower unit 3 and the upper unit 4. By rotating, the front cover 19 can be put into a closed position as indicated by solid line illustration in FIG. 1 and into an open position as indicated by two-dot chain line illustration in FIG. 1. By being put into the open position, the front cover 19 serves as a document receiver tray configured to receive ejected sheets of a document.

On its top face, the upper unit 4 includes a non-illustrated operation panel that offers a user interface for various kinds of operation, for example, an operation for read setting and an operation for read execution, and for display of the content of the read setting, etc. The operation panel appears when the front cover 19 is opened.

The document placement portion 5 is configured to be able to rotate on a rotation shaft 5*a* in a direction indicated by an arrow R1. By rotating, the document placement portion 5 can be put into a closed position as indicated by solid line illustration in FIG. 1 and into an open position as indicated by two-dot chain line illustration in FIG. 1. The closed position of the document placement portion 5 is an example of a second position. The open position of the document placement portion 5 is an example of a first position. By being put into the open position, the document placement portion 5 supports sheets of a document to be fed. Putting the document placement portion 5 into the closed position makes it possible to save the installation space of the apparatus.

Figure 4:
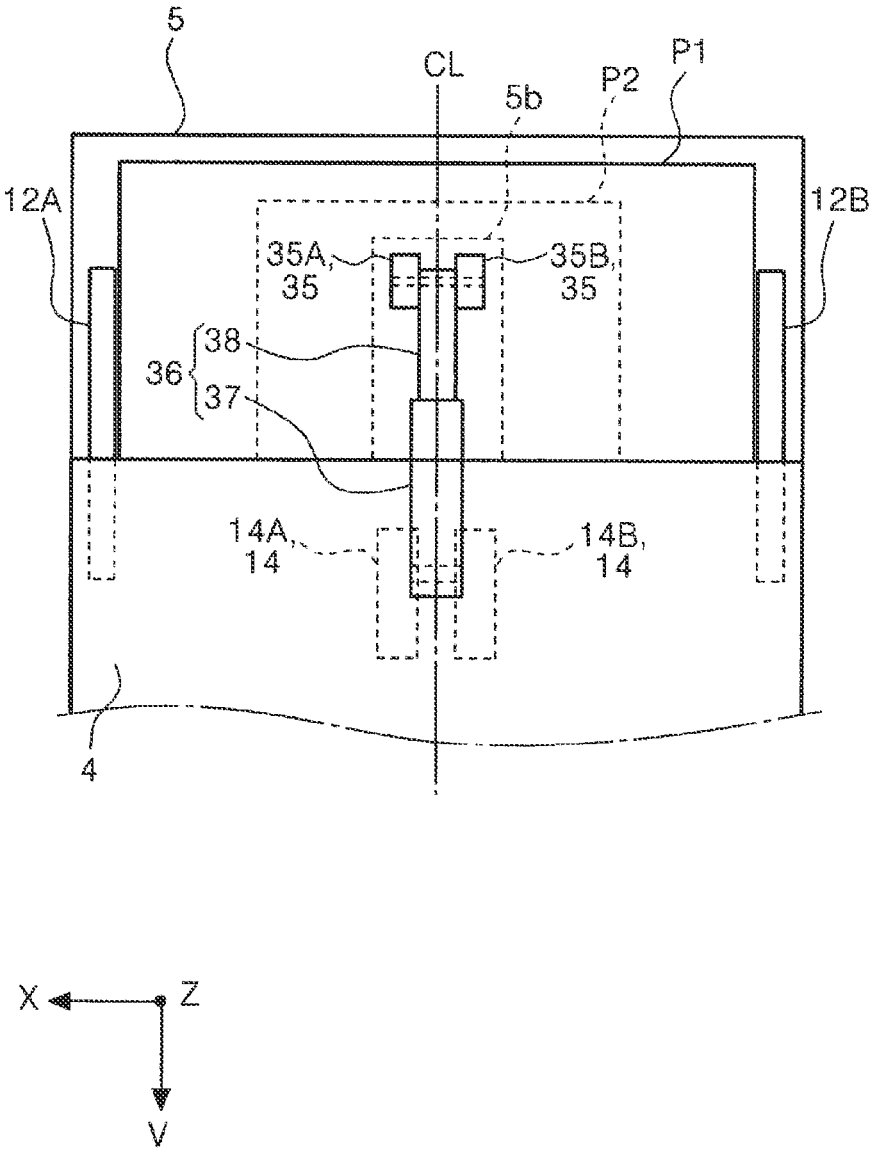
FIG. 4 is a plan view of the neighborhood of a document placement portion of a document feeding apparatus according to a first embodiment.

A pair of edge guides 12A and 12B is provided on the document placement portion 5. The edges of a document placed on the document placement portion 5 in the X-axis direction, that is, the width direction, are restricted by the pair of edge guides 12A and 12B as illustrated in FIG. 4. The edge guides 12A and 12B are configured to be able to change their respective positions in a direction of coming closer to each other and a direction of going away from each other by a non-illustrated rack pinion mechanism and configured to be able to be anchored at the changed positions by a non-illustrated friction anchoring mechanism. In FIG. 4, a line CL indicates a feed reference position in the width direction. The edge guides 12A and 12B are configured to be able to change their respective positions in the width direction while keeping positional symmetry with respect to the feed reference position CL.

Referring back to FIG. 1, the document feeding path T is a substantially linear document transportation path that is formed between the lower unit 3 and the upper unit 4.

The document placement portion 5 described above is provided at the most upstream end of the document feeding path T. A feed roller 14, which feeds a document, and a separation roller 15, which co-operates with the feed roller 14 so as to nip the document therebetween for sheet separation, are provided downstream of the document placement portion 5.

The feed roller 14 rotates by receiving motive power from a motor that is not illustrated in FIG. 1. The feed roller 14 is configured to be in contact with the bottom one of sheets of the document placed on the document placement portion 5. Therefore, if plural sheets are placed on the document placement portion 5, the sheets are fed sequentially downstream, the bottom one first.

The separation roller 15 is pushed toward the feed roller 14 by a non-illustrated spring. Rotational torque acting in a direction of returning the document upstream is transmitted from a non-illustrated motor to the separation roller 15 through a non-illustrated torque limiter.

As illustrated in FIG. 4, with respect to the feed reference position CL in the width direction, the feed roller 14 is provided on both sides as denoted as 14A and 14B, with an equal space left. The separation roller 15 is also provided on both sides with respect to the feed reference position CL, with an equal space left, though not illustrated in FIG. 4.

The document placement portion 5, the feed roller 14, and the separation roller 15 constitute a document feeding apparatus 9, which feeds a document as an example of a medium. Viewed differently, the document feeding apparatus 9 may be considered as an apparatus obtained by omitting a document reading function (a reading device 20 described below) from the scanner 1. Alternatively, the scanner 1, even without omitting the document reading function (the reading device 20 described below), may be considered as a document feeding apparatus if attention is focused on the feeding of a document.

Next, in FIG. 1, a pair of transportation rollers 16, the reading device 20 that is an example of a reading unit that acquires a document image by reading, and a pair of ejection rollers 17 are provided downstream of the feed roller 14. The document fed downstream while being nipped between the feed roller 14 and the separation roller 15 is nipped by the pair of transportation rollers 16 and is thereafter transported to a position facing an upper sensor unit 20A and a lower sensor unit 20B, which are provided downstream of the pair of transportation rollers 16.

The reading device 20 includes the upper sensor unit 20A, which is located above the document feeding path T and is provided in the upper unit 4, and the lower sensor unit 20B, which is located below the document feeding path T and is provided in the lower unit 3. The upper surface of the document is read by the upper sensor unit 20A, which is located above the document feeding path T. The lower surface of the document is read by the lower sensor unit 20B, which is located below the document feeding path T.

After reading of an image of at least one of the upper surface and the lower surface of the document at the reading device 20, the document is nipped by the pair of ejection rollers 17 located downstream of the reading device 20 and is thereafter ejected toward the front cover 19.

Next, a pressing portion that presses a document placed on the document placement portion 5 onto the document placement portion 5 at a position upstream of the feed roller 14 will now be explained.

Figure 2:
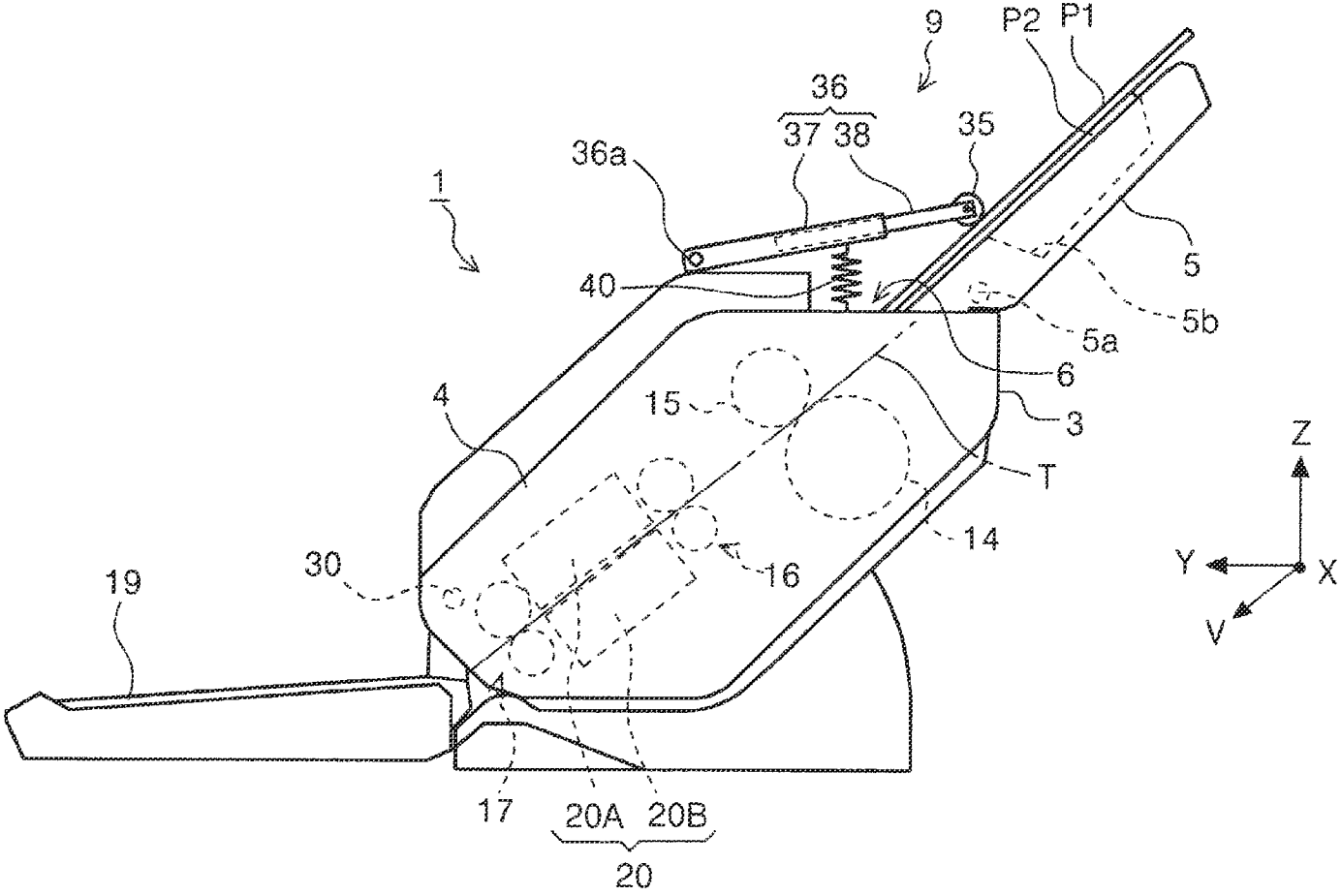
FIG. 2 is a side view of a document feeding path of a scanner according to a first embodiment.

As illustrated in FIGS. 2 and 4, a pivoting portion 36 is provided on the upper unit 4 in such a way as to be able to pivot on a pivot shaft 36*a*. The pivoting portion 36 is urged in an illustrated clockwise direction by a tension coil spring 40, which is an example of a pressing member. A roller 35, which is an example of a pressing portion, is provided on a free end away from the pivot shaft 36*a* of the pivoting portion 36. The roller 35 is rotatable freely.

In FIGS. 2 and 4, each of reference signs P1 and P2 denotes a document placed on the document placement portion 5. The size of the document P2 in the width direction is smaller than that of the document P1. Therefore, the edges of the document P2 in the width direction are not guided by the pair of edge guides 12A and 12B. When the document P1 that has a relatively large size and the document P2 that has a relatively small size are placed in a mixed manner as in this example, the edges of the smaller document P2 in the width direction are not guided by the pair of edge guides 12A and 12B, making it impossible to prevent or reduce a skew.

However, the document feeding apparatus 9 is provided with the roller 35, which is an example of a pressing portion that presses the document placed on the document placement portion 5 onto the document placement portion 5 at a position upstream of the feed roller 14 in the feeding direction. Therefore, a force of friction acts between the sheets placed on the document placement portion 5. The friction prevents or reduces a skew also for the document P2, which has a smaller size.

In addition, since the roller 35 is provided on the free end, which is away from the center of pivoting of the pivoting portion 36 configured to be able to pivot with respect to the upper unit 4, the position of the roller 35 is able to change suitably in accordance with the height of the stack of the sheets of the document on the document placement portion 5.

Moreover, in the present embodiment, the roller 35 is configured such that a pressing position where the roller 35 presses the document is adjustable in the document feeding direction. Therefore, it is possible to press the document at a suitable position depending on the length of the document in the document feeding direction.

More specifically, the pivoting portion 36 includes a base portion 37 and a slide portion 38. The base portion 37 is pivotable. The slide portion 38 is located in a direction toward the free end with respect to the base portion 37. The slide portion 38 is able to slide with respect to the base portion 37. In the present embodiment, a single slide portion 38 is provided. However, a plurality of slide portions 38 may be provided so that the pivoting portion 36 can be further expanded.

In the present embodiment, the slide portion 38 can be housed into the base portion 37. A force of friction acts between the slide portion 38 and the base portion 37, and, due to the force of friction, the slide portion 38 is held in position with respect to the base portion 37. However, the structure is not limited to this example. The slide portion 38 may be held in position with respect to the base portion 37 by a fastening member such as a screw. Alternatively, the slide portion 38 may be held in position with respect to the base portion 37 by engagement of a convex portion provided on either one of the slide portion 38 and the base portion 37 into a concave portion provided in the other at an appropriate engagement position, which may be at least one position.

Figure 3:
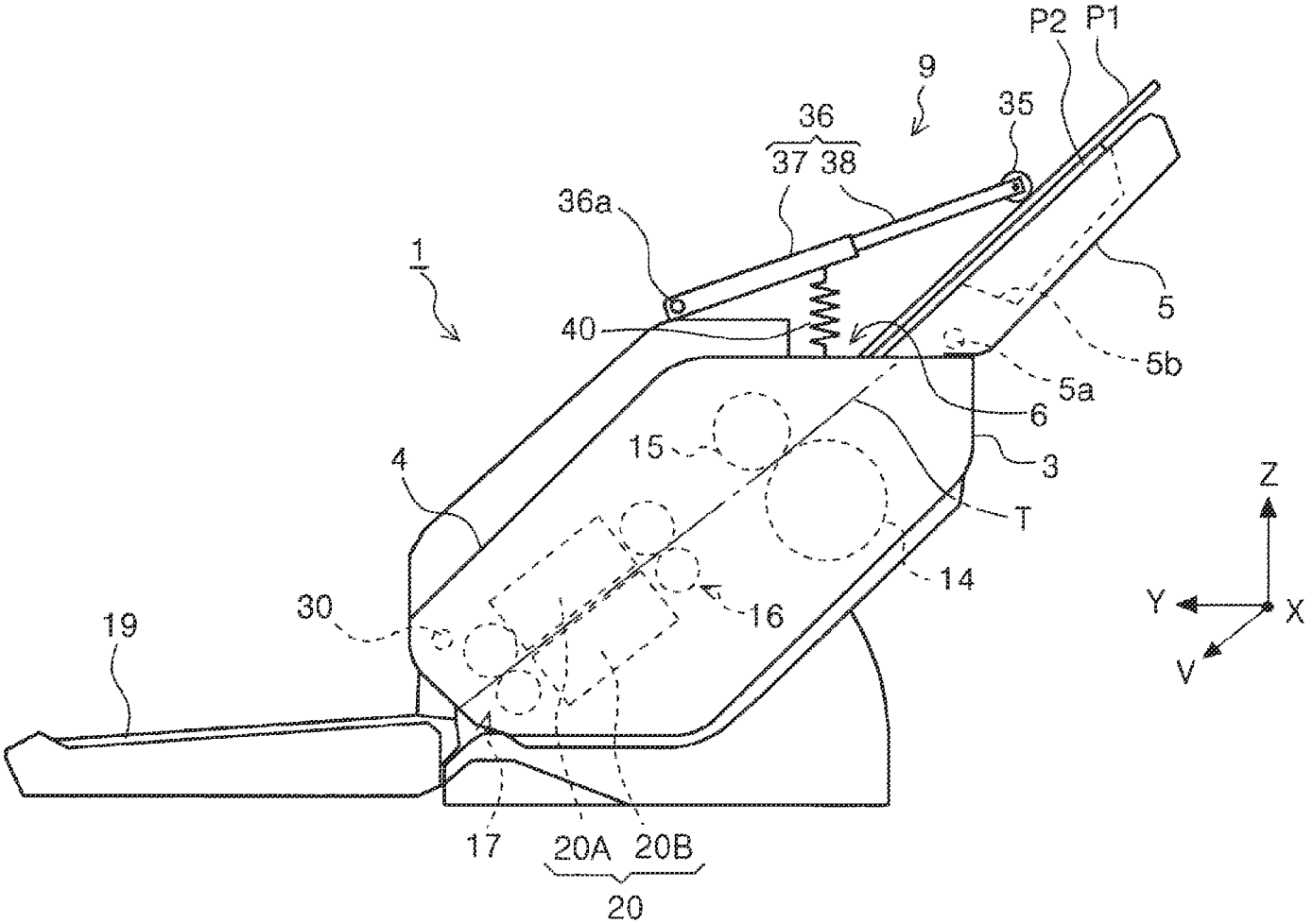
FIG. 3 is a side view of a document feeding path of a scanner according to a first embodiment.

Since the slide portion 38 is configured to be able to slide from the base portion 37 as explained above, the length of the pivoting portion 36 changes as can be seen from a comparison of FIG. 2 and FIG. 3. This makes it possible to easily adjust the position of pressing the document by the pressing portion, that is, the roller 35.

Moreover, in the present embodiment, the pivoting portion 36 is urged by the tension coil spring 40, which is an example of the pressing member, in a pivoting direction of pushing the roller 35 against the document placed on the document placement portion 5. Therefore, it is possible to easily adjust a pressing force applied by the roller 35 to press the document, by adjusting a press-urging force applied by the tension coil spring 40.

Furthermore, as is clear from a comparison of FIG. 2 and FIG. 3, the stretched length of the tension coil spring 40 is greater in FIG. 3, in which the extended length of the pivoting portion 36 is greater and in which a document that is relatively long in the feeding direction is pressed, as compared with FIG. 2, in which the extended length of the pivoting portion 36 is less and in which a document that is relatively short in the feeding direction is pressed. Because of the greater stretched length of the tension coil spring 40, in FIG. 3, the magnitude of the force of pressing the document by the pressing portion, that is, the roller 35, is greater. A document that is relatively long in the feeding direction is more prone to become skewed than a document that is relatively short in the feeding direction. Therefore, the greater stretched length of the tension coil spring 40 and the resultant greater magnitude of the force of pressing the document by the roller 35 make it possible to prevent or reduce a skew properly.

The document placement portion 5 has a recess 5*b*. The roller 35 enters the recess 5*b* when the document placement portion 5 switches from the first position, that is, the open position, to the second position, that is, the closed position. In other words, the roller 35 gets caught in the recess 5*b*, and, in this state, the slide portion 38 is pushed into the base portion 37 by the document placement portion 5. Therefore, the pivoting portion 36 becomes shorter. That is, the pivoting portion 36 changes into a slider-housed state in link with switching in position of the document placement portion 5. This structure enhances the ease of user operation.

It will be advantageous if the slide portion 38 is provided with a convex portion or a concave portion such as a finger hook so that a user will be able to perform an operation of sliding the slide portion 38, that is, an operation of extending or contracting the pivoting portion 36, easily also when the document placement portion 5 is in in an open state.

In the present embodiment, the pressing portion that presses the document is the roller 35 that rotates in contact with the document. This structure prevents the document from being damaged by the pressing portion when the document in contact with the roller 35 is fed.

It will be advantageous if the outer circumferential surface of the roller 35 is made of a material that produces a force of good friction with the document that is in contact therewith. For example, a rubber or an elastomer may be used as such a material for forming the outer circumferential surface. This makes it possible to prevent or reduce a skew of a document when the document in contact with the roller 35 is fed.

It will be advantageous if a roller that is able to rotate freely is provided on a document-supporting surface of the document placement portion 5. This structure reduces friction between the document that is fed and the document placement portion 5. Similarly to the roller 35 described above, it will be advantageous if this roller is made of a material that produces a force of good friction with the document that is in contact therewith. For example, a rubber or an elastomer may be used.

In the present embodiment, with respect to the feed reference position CL in the width direction, the roller 35 is provided on both sides as denoted as 35A and 35B in FIG. 4, with an equal space left. The roller 35A is provided at a position of overlapping with the feed roller 14A in the width direction. The roller 35B is provided at a position of overlapping with the feed roller 14B in the width direction.

If the position where the roller 35 presses the document and the position where a force for feeding the document is applied by the feed roller 14 to the document are significantly not in alignment with each other as viewed in the width direction, a skew is more likely to occur. By contrast, since the roller 35 is provided at a position of overlapping with the feed roller 14 in the width direction, the disclosed structure makes it possible to prevent or reduce a skew.

Although two rollers 35 are provided as an example of the pressing portion in the present embodiment, the scope of the disclosure is not limited thereto. Three or more rollers may be provided.

The roller 35A and the roller 35B are provided at symmetrical positions with respect to the feed reference position CL, which is the center between the pair of edge guides 12A and 12B in the width direction. The symmetry ensures that a balance is kept between the positions where the roller 35A and the roller 35B press the document and the positions where the pair of edge guides 12A and 12B restrict the edges of the document, thereby preventing or reducing a skew of the document.

If a single roller 35 is provided as an example of the pressing portion, it will be advantageous to provide the roller 35 at the center between the pair of edge guides 12A and 12B in the width direction. If an odd number of rollers 35 are provided, it will be advantageous to provide one roller 35 at the center between the pair of edge guides 12A and 12B in the width direction and arrange the other rollers 35 symmetrically with respect to the center.

Next, with reference to FIG. 5, an image reading apparatus according to a second embodiment will now be explained. A scanner 1A as an example of an image reading apparatus illustrated in FIG. 5 includes a document feeding apparatus 9A. The document feeding apparatus 9A is a variation example of the document feeding apparatus 9 described above. In the description below, an explanation of the same structure as the structure explained already above is omitted.

The document feeding apparatus 9A includes a supporting member 41. The supporting member 41 is configured to be able to pivot on a pivot shaft 41*a* in a direction indicated by an arrow R3. By pivoting, the supporting member 41 is able to switch between a lying state as indicated by two-dot chain line illustration and an erect state as indicated by solid line illustration. The supporting member 41 may be configured to pivot automatically by receiving motive power from a motor, etc. The supporting member 41 may be operated by a user for pivotal movement.

Figure 5:
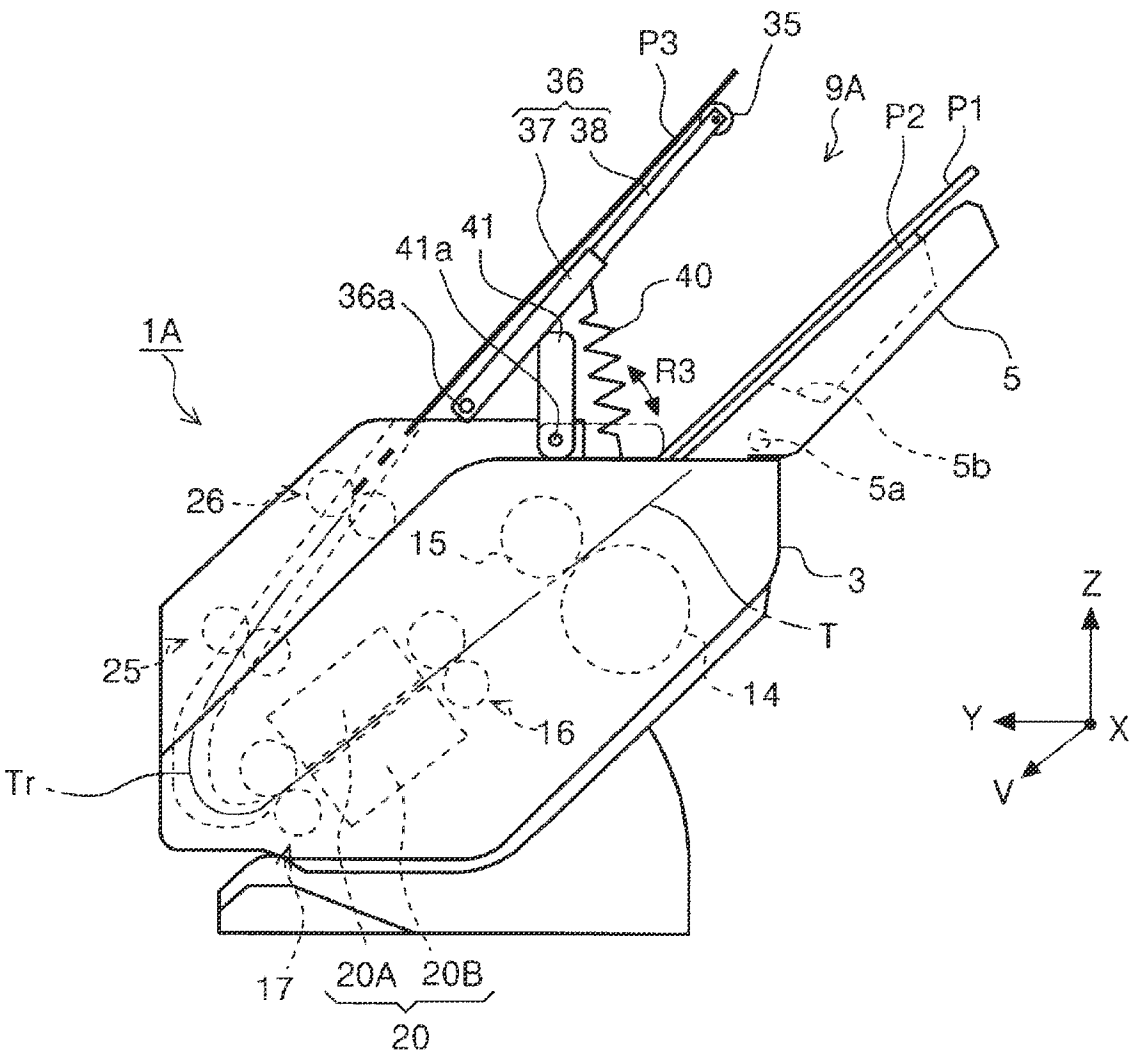
FIG. 5 is a side view of a document feeding path of a scanner according to a second embodiment.

When the supporting member 41 is in the erect state indicated by solid line illustration, the supporting member 41 is able to support the pivoting portion 36 from below as illustrated in FIG. 5. When the supporting member 41 is in the lying state indicated by two-dot chain line illustration, the supporting member 41 does not interfere with the pivoting portion 36 and, therefore, the roller 35 as an example of the pressing portion is able to press the document placed on the document placement portion 5.

In the scanner 1A, a turnover reverse feeding path Tr is connected downstream of the document feeding path T. The document after reading is fed by a pair of feed rollers 25 and next by a pair of feed rollers 26 in a tilted direction that is the same as the tilt orientation of the document placement portion 5, that is, obliquely upward. The document fed obliquely upward is supported by the pivoting portion 36 as indicated by a reference sign P3.

The structure described above makes it possible to reduce the cost of the apparatus because the pivoting portion 36 serves also as a supporting unit that supports the ejected document in a tilted position.

The structure for keeping the positional state of the pivoting portion 36 when the pivoting portion 36 serves also as the supporting unit that supports the ejected document in a tilted position is not limited to the supporting member 41 described above. Any other structure may be adopted. For example, a convex portion and a concave portion may engage with each other to keep the positional state of the pivoting portion 36 when the pivoting portion 36 switches into the position illustrated in FIG. 5.

Figure 6:
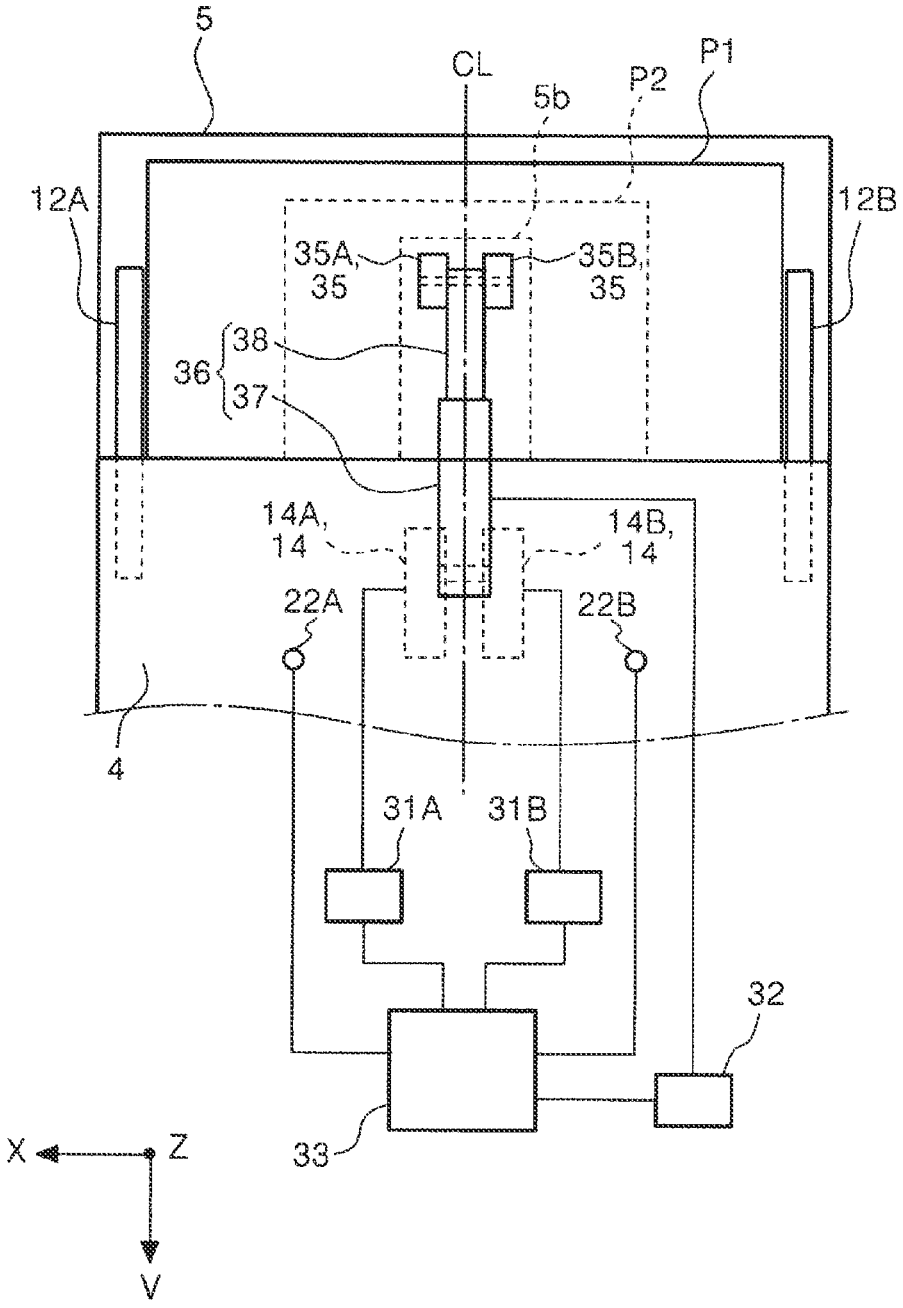
FIG. 6 is a plan view of the neighborhood of a document placement portion of a document feeding apparatus according to a third embodiment, illustrated together with a block configuration of a part of a control system thereof.
Figure 7:
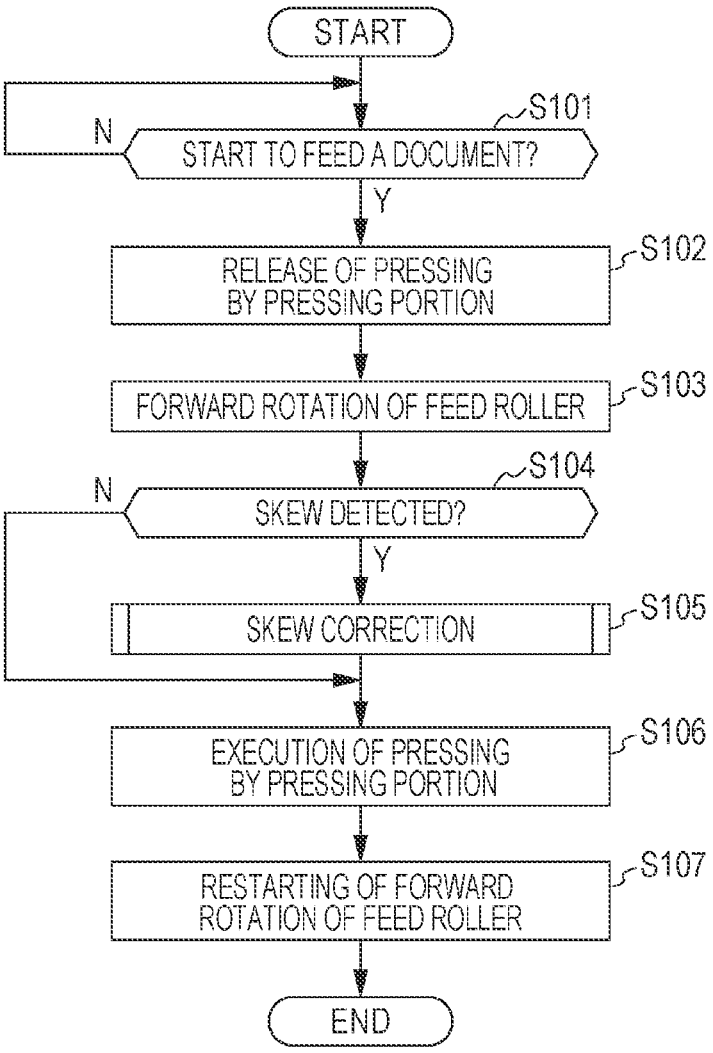
FIG. 7 is a flowchart illustrating the flow of document feeding control performed by a control unit of a document feeding apparatus according to a third embodiment.

Next, with reference to FIGS. 6 and 7, an image reading apparatus according to a third embodiment will now be explained. In FIG. 6, the feed roller 14A and the feed roller 14B are driven by motors provided exclusively for them respectively. The reference sign 31A denotes a first feed motor that drives the feed roller 14A. The reference sign 31B denotes a second feed motor that drives the feed roller 14B. The first feed motor 31A and the second feed motor 31B are controlled by a control unit 33.

Under the control of the control unit 33, the pivoting portion 36 is able to pivot by receiving motive power from a pivoting portion drive motor 32. By this means, the roller 35 as an example of the pressing portion switches between a pressing state, in which the document placed on the document placement portion 5 is pressed, and a pressing released state, in which the pressing is released. Therefore, the pivoting portion drive motor 32 behaves as a pressing state switcher that switches the state of pressing the document by the roller 35. No electric power supply to the pivoting portion drive motor 32 is performed in the pressing state. Therefore, in this state, the pivoting portion 36 is able to pivot freely.

In FIG. 6, each of reference signs 22A and 22B denotes a document detection sensor provided downstream of the feed roller 14. In the description below, the document detection sensor denoted as 22A is referred to as a first document detection sensor, and the document detection sensor denoted as 22B is referred to as a second document detection sensor. The first document detection sensor 22A and the second document detection sensor 22B are provided on respective sides with respect to the feed reference position CL, with an equal space left. Detection signals outputted by the first document detection sensor 22A and the second document detection sensor 22B are inputted into the control unit 33.

Next, with reference to FIG. 7, control performed by the control unit 33 will now be explained. Upon receiving an instruction for starting to feed a document (step S101: Yes), the control unit 33 causes the pressing portion, that is, the roller 35, to release the pressing of the document (step S102). Next, the forward rotation of the feed roller 14A and the feed roller 14B is started (step S103). The control may be performed such that the pressing of the document by the pressing portion, that is, the roller 35, has been released in a feed standby state.

Then, based on the detection signals outputted by the first document detection sensor 22A and the second document detection sensor 22B, the control unit 33 detects a skew of the document (step S104). It is possible to determine whether the document is skewed or not based on the difference between the time at which the leading edge of the document is detected by the first document detection sensor 22A and the time at which the leading edge of the document is detected by the second document detection sensor 22B.

If the skew of the document is detected, more specifically, if the detected skew is in excess of a tolerance value determined in advance (step S104: Yes), the control unit 33 performs skew correction (step S105).

In the present embodiment, the skew correction is performed by stopping one of the feed roller 14A and the feed roller 14B at which the leading edge has arrived earlier, and by rotating the other, at which there is a relative delay, in the forward direction (step S105). Therefore, the first feed motor 31A, the second feed motor 31B, the first document detection sensor 22A, and the second document detection sensor 22B constitute a skew correction unit that corrects the skew of the document.

However, the skew correction unit is not limited to this example. Any other method may be used as long as it is possible to correct the skew by rotating the document.

As explained above, the control unit 33 commands that the skew correction should be performed in a state in which the pressing of the document by the pressing portion, that is, the roller 35, has been released. Therefore, it is possible to correct the skew of the document properly, without being obstructed by the pressing of the document by the roller 35.

After the execution of the skew correction, the control unit 33 causes the pressing portion, that is, the roller 35, to press the document (step S106), and causes the feed roller 14 to restart the forward rotation (step S107).

The scope of the present disclosure is not limited to the foregoing embodiments. The present disclosure can be modified in various ways within the scope of the recitation of appended claims. Needless to say, such modifications are within the scope of the present disclosure.

What is claimed is:

1. A medium feeding apparatus, comprising:

a medium placement portion on which a medium before being fed is placed;

a feed roller that feeds the medium placed on the medium placement portion;

at least one pressing portion that presses the medium placed on the medium placement portion onto the medium placement portion at a position upstream of the feed roller in a medium feeding direction;

a lower unit that includes the medium placement portion;

an upper unit that is provided over the lower unit, wherein the medium placement portion is able to rotate with respect to the lower unit and is able to, by rotating, switch between a first position, at which the medium placement portion supports the medium, and a second position, at which the medium placement portion covers a medium feed port formed between the lower unit and the upper unit; and a pivoting portion that is able to pivot with respect to the upper unit, wherein, by switching of the medium placement portion from the first position to the second position, the medium placement portion pushes a slide portion towards a base portion included in the pivoting portion, resulting in making a length of the pivoting portion shorter.

2. The medium feeding apparatus according to claim 1, wherein the at least one pressing portion is configured such that a pressing position where the at least one pressing portion presses the medium is adjustable in the medium feeding direction.

3. The medium feeding apparatus according to claim 2, further comprising:

a medium feeding path along which the medium is fed and which is formed between the lower unit and the upper unit, wherein the at least one pressing portion is provided on a free end that is away from a center of pivoting of the pivoting portion.

4. The medium feeding apparatus according to claim 3, wherein the slide portion is located in a direction toward the free end with respect to the base portion, and the base portion is pivotable, wherein the length of the pivoting portion changes to adjust the pressing position due to sliding of the slide portion with respect to the base portion.

5. The medium feeding apparatus according to claim 4, wherein the pivoting portion is urged by a pressing member in a pivoting direction of pushing the at least one pressing portion against the medium placed on the medium placement portion.

6. The medium feeding apparatus according to claim 1, wherein the at least one pressing portion is a roller that rotates in contact with the medium.

7. The medium feeding apparatus according to claim 1, wherein the at least one pressing portion is provided at a position of overlapping with the feed roller in a width direction that intersects with the medium feeding direction.

8. The medium feeding apparatus according to claim 7, further comprising:

a pair of edge guides that are able to slide in the width direction that intersects with the medium feeding direction;

wherein the at least one pressing portion is provided either at a center position between the pair of edge guides in the width direction or at symmetrical positions with respect to the center position.

9. The medium feeding apparatus according to claim 3, wherein the pivoting portion serves also as a supporting unit that supports an ejected medium in a tilted position.

10. The medium feeding apparatus according to claim 1, further comprising:

a skew correction unit that corrects a skew of a document;

a pressing state switcher that switches between a pressing state, in which the medium is pressed by the at least one pressing portion, and a pressing released state, in which the pressing is released; and a control unit that controls the skew correction unit and the pressing state switcher;

wherein the control unit causes the skew correction unit to correct the skew of the document after putting the at least one pressing portion into the pressing released state.

11. An image reading apparatus, comprising:

a reading unit that reads a surface of the medium; and the medium feeding apparatus according to claim 1.

12. A medium feeding apparatus, comprising:

a medium placement portion on which a medium before being fed is placed;

a feed roller that feeds the medium placed on the medium placement portion;

at least one pressing portion that presses the medium placed on the medium placement portion onto the medium placement portion at a position upstream of the feed roller in a medium feeding direction;

a lower unit that includes the medium placement portion;

an upper unit that is provided over the lower unit; and a pivoting portion that is able to pivot with respect to the upper unit, wherein the pivoting portion includes a base portion that is pivotable and at least one slide portion that is located in a direction toward a free end with respect to the base portion and is able to slide with respect to the base portion, a length of the pivoting portion changes to adjust the pressing position due to sliding of the at least one slide portion with respect to the base portion, and the pivoting portion is urged by a tension coil spring in a pivoting direction of pushing the at least one pressing portion on the medium that is placed on the medium placement portion.

* * * * *